United States Patent [19]

Platt

[11] Patent Number: 4,916,877

[45] Date of Patent: Apr. 17, 1990

[54] FIRE STRIP CONSTRUCTION

[75] Inventor: William J. Platt, Collingdale, Pa.

[73] Assignee: National Rolling Mills, Inc., Frazer, Pa.

[21] Appl. No.: 375,567

[22] Filed: Jul. 3, 1989

Related U.S. Application Data

[63] Continuation-in-part of Ser. No. 269,921, Nov. 10, 1988, Pat. No. 4,864,791.

[51] Int. Cl.[4] ..... E04B 5/52

[52] U.S. Cl. ..... 52/317; 52/232; 52/484; 52/573; 52/DIG. 5

[58] Field of Search ..... 52/317, 484, 488, 232, 52/475, DIG. 5, 573, 221; 428/920, 681, 685, 619, 12, 14, 137, 167, 60, 921, 542.8, 542.2

[56] References Cited

U.S. PATENT DOCUMENTS

| | | | |
|---|---|---|---|
| 2,099,961 | 11/1937 | McLaughlin, Jr. . | |
| 3,119,475 | 1/1964 | Adams | 52/232 |
| 3,189,138 | 6/1965 | Znamirowski | 52/232 X |
| 3,333,378 | 8/1967 | Jahn et al. . | |
| 3,473,282 | 10/1969 | Robinson, Jr. . | |
| 3,783,771 | 1/1974 | Hartzell et al. | 52/484 |
| 4,496,790 | 1/1985 | Spencer | 52/221 X |
| 4,594,832 | 6/1986 | Akins . | |
| 4,791,766 | 12/1988 | Egri, II . | |

FOREIGN PATENT DOCUMENTS

| | | | |
|---|---|---|---|
| 1055220 | 5/1979 | Canada . | |
| 809976 | 3/1959 | United Kingdom | 52/232 |

*Primary Examiner*—Richard E. Chilcot, Jr.
*Attorney, Agent, or Firm*—Eugene Chovanes

[57] ABSTRACT

A fire strip for a suspended grid ceiling has an inner spring steel web having a slightly arcuate cross section, and an outer web of soft steel wrapped around the inner web. A finished strip is formed by bending the strip normal to the strip body at both ends. When the ends are bent, a spring-like, yieldable, upwardly curved arch is formed which fits snugly against a panel when in place in a ceiling.

1 Claim, 4 Drawing Sheets

FIRE STRIP CONSTRUCTION

This application is a continuation-in-part of co-pending application Ser. No. 269,921 filed Nov. 10, 1988 for FIRE STRIP now U.S. Pat. No. 4,864,791.

BACKGROUND OF THE INVENTION

The Prior Art

Ceilings in commercial and industrial structures are often of the suspended ceiling type wherein a metallic grid is suspended from the structural ceiling by, for instance, hanging wire. The grid forms rectangular openings of generally 2'×4' size which support standard size 2'×4' acoustical panels. The main and cross members of the grid are formed of inverted T-shape metallic members having a web and flange. The flange forms a shelf around the inside of the grid opening to support the acoustical tile which is laid on top of the shelf. The web of the grid member serves to keep the tile aligned in the grid opening. The grid members are suitably interconnected at their intersections.

PROBLEMS IN THE PRIOR ART

Problems occur in the prior art ceiling described above during a fire. The heat from the fire causes the grid members to expand and twist, so that they no longer support the tile. The tile drops out, leaving the space above the ceiling open to the fire, permitting the fire to spread.

Numerous prior art efforts have been made to keep the grid relatively intact and capable of continuing to support the tile during a fire, whereby the tile, which is generally fire-resistant, can act as a barrier to further spread of the fire into the space above the suspended ceiling. The suspended ceiling is generally damaged and must be replaced after a fire, even if the tile continues to be supported, but it is the barrier effect during a fire which the prior art has sought to achieve in a fire-rated suspended grid ceiling.

The general approach to keeping the ceiling relatively intact during a fire involves means for permitting expansion of the metal grid members. Expansion means are sometimes provided at the member intersections by various forms of overlapping expansion joints. These involve often complicated configurations.

By permitting the grid members to expand longitudinally, the tendency of the members to buckle and twist is reduced, so that the tiles are more likely to stay in place.

Sometimes expansion means are provided along the lengths of the members, such as by pre-formed bend points which permit the cross or main grid members, which are in effect beams, to bend in a certain way to accommodate the expansion, while keeping most of the grid members relatively straight and intact, whereby it continues to support the tile.

At best, however, even with expansion means, the tiles sometimes fall out during a fire.

It is also noted that expansion means often weaken the installed grid during normal conditions, since the grid members are generally perforated to provide these expansion means.

THE PRESENT INVENTION GENERALLY

The present invention generally is concerned with an improvement to prior metallic ceiling grid structures for supporting acoustical tile. Such prior art grids have metal main and cross members formed of inverted T-shape cross sections. The grid openings are generally 2'×4' openings. A standard 2'×4' acoustical tile panel is supported within the grid opening on the flanges of the T-shape.

Such a prior art ceiling is made more fire-resistant by attaching the flat metallic strip of the invention to opposing cross members in the center of the grid opening to provide what appears to be 2'×2' grids when viewed from below.

During a fire, the strip keeps the panel in place in the ceiling since the grid opening through which the panel can fall is reduced. The strip also supports the panel, and resists the buckling and twisting of the T-shape grid members.

When viewed from below, the strip appears to be one of the grid members, so that the same general ceiling appearance is maintained. For instance, where the ceiling is composed of 2'×4' acoustical tiles, the ceiling appears to be composed of 2'×2' tiles when the fire strip of the invention is used.

Generally, the flange "shelf" supporting the standard 2'×4' acoustical tile is about ½" wide, so there is very little area of support for the tile to begin with; namely, a ½" shelf around a panel which measures nominally 24"×48". Since even with the prior art means described above, it is virtually impossible to prevent some buckling and twisting, particularly in the cross beams (the 48" length, or the long side of the grid opening). Since the tile is being supported by a ½" edge "shelf", even a minor amount of buckling and twisting opens up the grid, permitting the tile to drop.

The present strip prevents the tile from dropping during a fire by (1) strengthening the grid against uncontrolled buckling and twisting, (2) substantially reducing the grid opening through which the tile can fall to an area well below the tile size so that the tile is virtually prevented from falling through the grid opening, (3) forming secondary rectangular openings within the primary grid openings formed of the structural T-shape main members and cross members, (4) keeping the individual secondary grid opening relatively rectangular in shape even when the structural T-members buckle and twist; and (5) providing substantial additional shelf support for the tile panel.

A flat strip, or strap, of metal, suitably conforming in appearance and shape to the flange of the T-shape ceiling structural grid member when viewed from below the ceiling, is inserted between the main members forming the grid opening. The strip extends parallel to the main members and perpendicular to the cross members.

The strip desirably bisects a typical 2'×4' grid opening into two 2'×2' grid openings. A 2'×4' tile panel rests, as in the prior art, on the perimeter shelf formed by the flanges of the grid members, and also on the strip itself which is suitably secured to the cross members.

Although the present invention is illustrated with beams having flat underfaces on the flanges of the T-shape cross sections, it should be understood that the strip of the invention works equally well with other shapes on the underface of the flange. Such shapes are well known and in cross section constitute for instance slots, tier drops, box sections, and a bolt slot pattern. In such instances, the underface of the strip conforms to the underface of the beam flange. The top of the strip, however, continues to be flat as hereafter illustrated.

The strip of the invention can be used with prior art ceilings that have expansion means and are fire-rated as well as with normal non-fire rated ceilings known as Class A ceilings, as classified in the construction trade. The benefits of the invention are obtained with all types of ceilings.

In a fire, the strip acts, among other things, to keep cross members from uncontrolled buckling, one away from the other. The strip also resists twisting of the cross members during a fire. The strip also serves to support the tile panel during a fire, at the panel's general mid-section. The strip also continues to form one side of a grid opening that is substantially less than the normal size, making it virtually impossible for the relatively large panel to drop out of the relatively small grid opening.

The invention permits the relatively large panel, for instance a 2'×4' panel, to be inserted in a conventional prior art suspended grid ceiling in a conventional manner around the grid opening perimeter), after which the fire strip of the invention is secured, wherein all the benefits set forth above are secured.

THE INVENTION SPECIFICALLY

The invention specifically is directed to the fire strip set forth above wherein the strip has a yieldable, upwardly curved, spring-like arch, and particularly the construction of such a strip.

Without a spring-like, upwardly curved arch, it has been found it is extremely difficult to get a snug fit of the strip against the tile. The flat strip lacks the stiffening effect of the web in the T-cross section of the grid members. The strip without the preformed arch sags, much as a clothesline sags, since it is virtually impossible to eliminate the downward component of the strip weight in the opposing horizontal forces at the end of the strip.

In the present invention, the desirable spring-like arch is achieved by forming the strip of a laminate having a continuous inner web curved in cross section, and a continuous outer web wrapped around the inner web. The laminate is cut into suitable lengths, and then bent at both ends to form attachments to the grid members, and to form the arch. The laminate strip, when so bent, forms the desired spring-like arch.

BRIEF DESCRIPTION OF THE DRAWINGS

FIG. 3*a* shows a vertical slot at one end of the strip and opposing tabs at the other end of the strip.

FIG. 3*b* shows a strip having holes at the ends thereof to receive self-tapping screws.

FIG. 3*c* shows a strip having opposed bends at the opposite ends for insertion through a slot in the grid members.

DETAILED DESCRIPTION OF FIGS. 1 THROUGH 3 OF THE DRAWINGS

Figure 1:
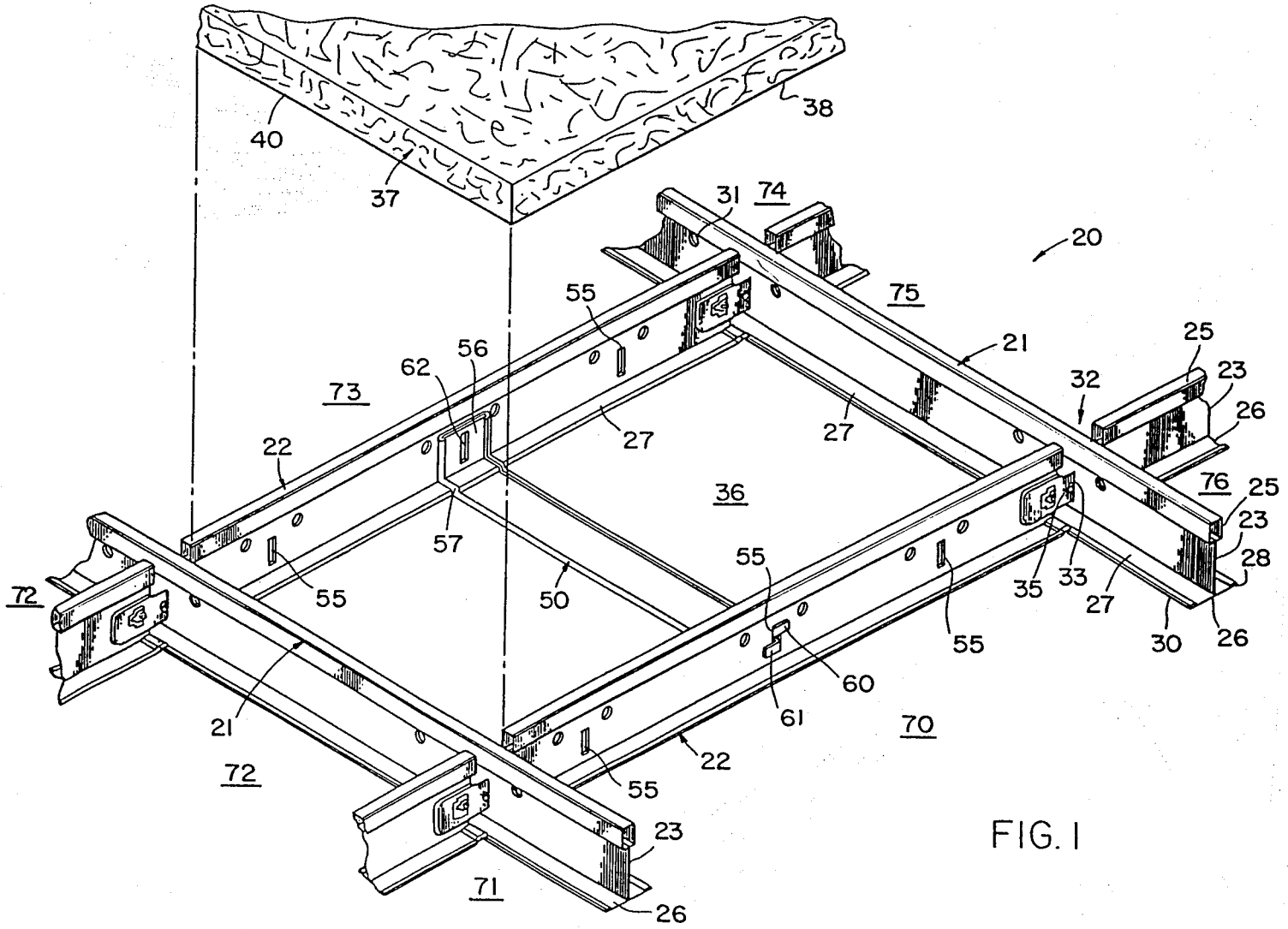
FIG. 1 is a perspective exploded view of a section of a suspended ceiling showing the strip of the invention in place.

There is shown in FIG. 1 a perspective view of a suspended ceiling 20 having main members 21 and cross members 22. The main members 21 and cross members 22 are T-shaped in cross section and have a web 23, a bulb 25 at the top thereof and a flange section 26 having opposed flanges 27 and 28. The flanges have suitable beads 30 along the edges thereof.

Both the main members 21 and cross members 22 are shown having the same cross-sectional shapes. The main members 21 extend longitudinally of the ceiling and are suspended from the structural ceiling through wires (not shown) which engage suspension holes 31 in the well known prior art manner. Main members 21 extend parallel to one another at a distance generally on 4' centers, and have extending therebetween cross members 22 which suitably interlock to the main members at interlock 32. Such interlocks are of various types and are well known in the prior art. In the interlock shown, a slot 33 receives tongue 35 at the end of cross members 22. The tongues 35 from the opposing cross members on either side of the main grid member 21 extend adjacent one another through the slot and have suitable detents or the like which keep the beams interlocked.

In ceiling grids of a fire-rated type, various different interlocks or joints 32 provide expansion means whereby under the heat of a fire, the cross members expand longitudinally through the main beam, wherein the abutting tongues overlap one another and slide with respect to one another, permitting expansion and reducing the buckling and twisting effect which occurs during a fire. The twisting and bending effect on the cross member occurs when free expansion of the member longitudinally during a fire is blocked, as it virtually always is, because of the grid interconnections.

Normally, the cross members 22 which extend parallel to one another are spaced on 2′ centers, and the main members are spaced on 4′ centers. This results in a 2′×4′ grid opening 36, rectangular in horizontal area, having a flange 27 extending around the entire interior perimeter of the grid opening 36, forming a shelf 29. The flange is on the order of ½″ in width. An acoustical tile 37 of a 2′×4′ dimension corresponding to the grid opening 36 formed between webs 23 of members 21 and 22 is inserted in assembling the ceiling through grid opening 36 at an angle and then leveled into a horizontal position and laid upon flanges 27 that extend around the interior perimeter of grid opening 36. The acoustial tile is of the well known prior art type of for instance ½″ in thickness of a composite fiberboard and has long sides 38 and short sides 40 which form a rectangle of a 2′×4′ dimension in the assembly being desribed. The 2′×4′ panel is laid on the shelf and the sides 38 abut webs 23 of cross members 22. Sides 40 of tile 37 abut webs 23 of main members 21.

The above description is by way of illustration only and is illustrative of the well known prior art structures.

The device of the invention involves a fire strip 50 which extends between cross members 22. The strip 50 has at both of its ends fastening means 51 for so securing the strip to member 22. The strip 50 has a body portion 52 which desirably conforms in thickness to flange portion 26 of the grid members 21 and 22 so that the strip conforms in appearance when viewed from below the ceiling to the members 21 and 22. Bead 53 conforming to bead 30 of the grid members extends along the edges of the strip.

In FIG. 1, there is shown slots 55 spaced periodically along the cross members. Selected slots 55 receive fastening members 51 of strip 50. The strip is slightly less in length than the exact distance between the webs 23 of opposing cross members 22, so that the strip can be easily inserted in place without interference. In the assembly being illustrated, this distance would be slightly less than 2′ in length.

Figure 2:
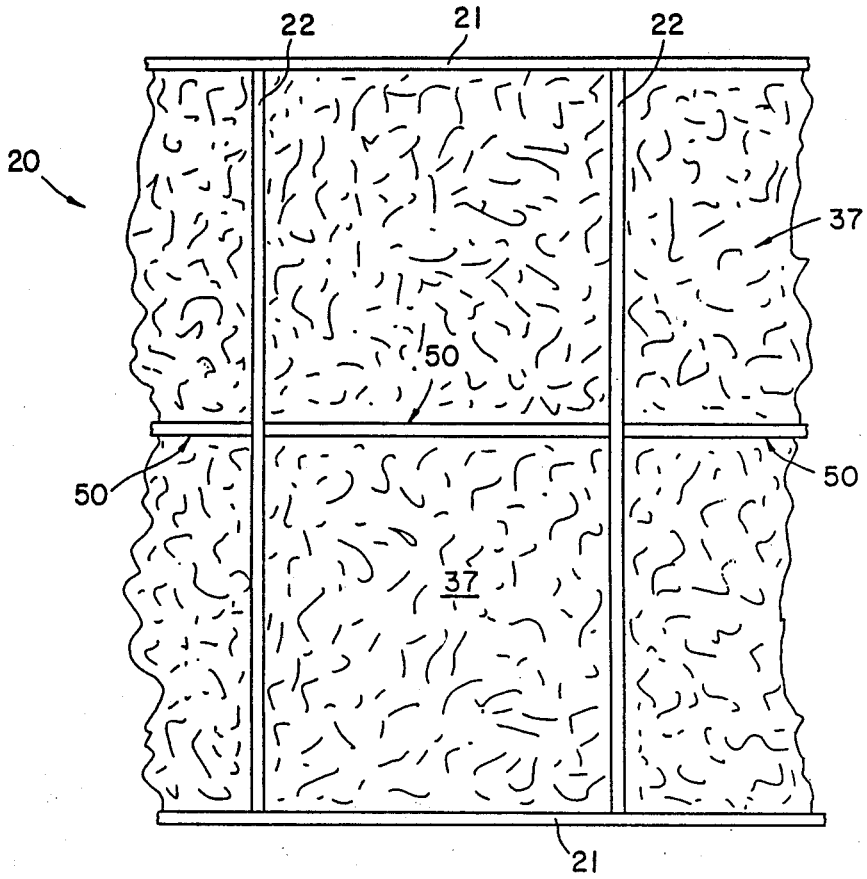
FIG. 2 is a bottom plan view of a section of a suspended ceiling showing the strip of the invention.

Fastening elements 51 have angle portion 56 extending upward from body portion of the strip 50. The strip has a suitable offset 57 at each end. Offset 57 conforms to the thickness of the flange 27 on cross member 22. The offset 57 extends in length the width of flange 27, for instance ½″. When inserted between cross members 22 and viewed from below, the lower face of web portion 52 of strip 50 extends in the same plane as the lower face of cross members 22 and main members 21. When viewed from below as seen in FIG. 2, strip 50 is indistinguishable from main members 21 and cross members 22 and would appear to be one of such members having a T-shape cross section wherein 2′×2′ tiles are being used. Such appearance is illusory only, since 2′×4′ tiles are being used in 2′×4′ grid openings with fire strip 50 inserted midway between opposing main members 21.

Figure 3A:
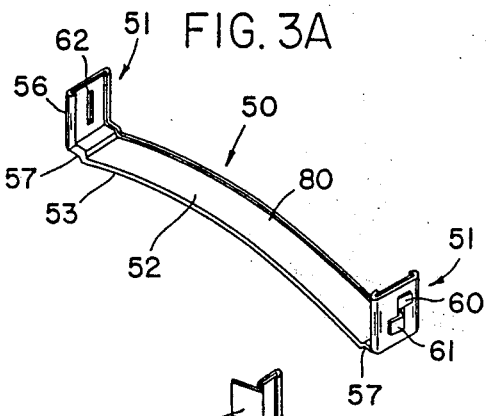
FIGS. 3*a*, 3*b* and 3*c* are perspective views of the various embodiments of the strip of the invention.
Figure 3B:
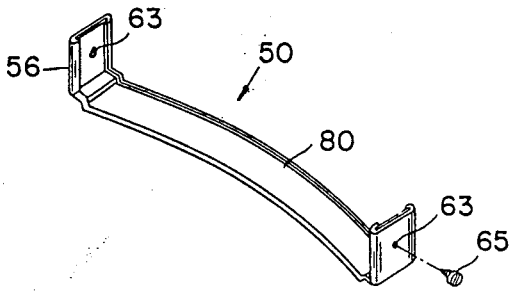
Figure 3C:
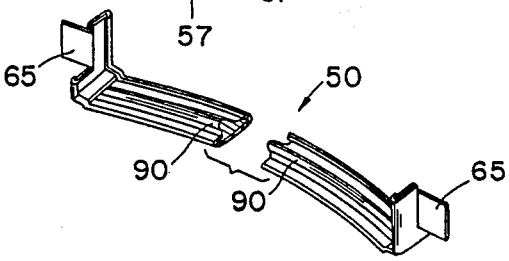

In FIG. 1, opposing tabs 60 and 61 have been bent in opposing directions after being inserted through the slot with the tabs extending longitudinally of the strip as seen for instance in a single tab 61 in FIG. 3*c*.

Fastening member 51 can also take the form of simply a slot in angle 56. A slot 62 as seen in FIG. 1 and FIG. 3*a* is aligned with slot 55 in cross member 22 after which a separate fastening clip or pin can be inserted through the matching slots and then bent or otherwise secured.

The intent of fastening means 56 is to securely fix end of fire strip 50 to cross beam 22. Alternative forms of fastening means 51 are shown in FIGS. 3*a* through 3*c*. *In 3b*, angle 56 has hole 63 which receives a self-tapping screw 65 which passes through a connecting slot 55 in cross member 22. In FIG. 3*c*, there is shown a single tab 65 which extends through slot 55 on cross member 22. It should be understood that the various illustrative fastening means shown are merely illustrative and that any suitable fastener in the form of a clip, tab, screw, detent, nut and bolt, or the like can be used.

It is intended that the fire strip be inserted into the ceiling grid as shown after the acoustical tile 37 has been inserted through grid opening 36 and temporarily suspended above the grid opening while the strip is attached.

In the alternative, the strip can be inserted into one grid opening and the panel brought into place through adjacent grid opening 36 which has not yet received its fire strip. The panel is simply spaced over the main or cross member or members and laid in place within the confines of webs 23 on opposing cross members 22 and opposing main members 21 on top of the flanges 27 and fire strip 50.

It should be understood that the strips are placed in continuing longitudinal alignment with one another as seen for instance in FIG. 2. Only one strip is shown in a grid opening 36, for purposes of clarity, but in an actual ceiling, it is intended that strips also be placed in adjacent grid openings 70 through 76.

It is desirable that fastening means 51 be such that they can be inserted from each side of the same slot 55 in cross member 22, and fastened thereto.

The body 52 of fire strip 50 is desirably preformed to have a bowed or arched configuration 80 wherein the body or arch is curved upwardly in a spring-like effect. When the tile 37 is inserted, the body or arch 80 is forced downwardly into a horizontal plane wherein strip 50 snugly fits against the panel. It should be understood the body or spring effect is a very slight one, and not to a degree that would lift the tile 37 from a resting posture on flanges 27. The body or spring effect is simply to keep the strip from any sagging or spacing from the tile 37 itself, and eliminates any need for an exact, precise length of fire strip 50 wherein any tendency to sag would be eliminated by exerting tension on the ends of the strip. The arch or body 80 is desirable but not necessary in practicing the invention.

During a fire, the grid members 21 and 22 expand from the effects of the heat. Joints 32 may or may not absorb some of this expansion. Fire strip 50 keeps opposing members 22 at its end, from buckling in directions non-parallel to one another, thus maintaining the integrity of the 2′×2′ grid opening formed by the strip. The buckling which does occur is in generally parallel relationship in both opposing members 22. Additionally, strip 50 with its fastening means 51 can keep members 22 from twisting, whereby flange 27 rotates, thus providing a larger opening and thus allowing tile 37 to follow. Additionally, strip 50 simply locks the large tile from falling through, since it extends midway along the 4′ dimension of opening 36, in effect creating a 2′×2′ grid opening through one 2′×4′ grid.

In an alternative embodiment of the invention, the body 52 of fire strip 50 may have running longitudinally along its top side a reinforcing ridge or bead 90 as seen broken away in FIG. 3*c*. Such bead or ridge 90 serves to stiffen the strip to prevent sagging. The tile panel if necessary may be correspondingly notched or scored along a line which corresponds to ridge or bead 90, to avoid any interference. It should be understood, however, that if the panel is so scored or notched, the length of such notch is not such that would weaken the panel structurally. For instance, in a panel having a thickness of ⅝″, the depth of the notch would generally not exceed 5/16″. The intent of the invention is to keep the panel in one piece, and to use the fire strip as explained above, to support the panel in the manner described.

It is understood of course that any fire-rated ceiling including one using the device of the invention will suffer damaging effects during a fire, and generally must be replaced since even with the device of the invention, there is of course substantial structural damage in the form of breaks, twists, buckling and the like. The purpose of the invention, as is the purpose generally of a fire-rated suspended ceiling, however, is not to prevent the ceiling from being damaged during a fire, but rather to keep the ceiling structurally intact including keeping the tiles in place during a fire so that the ceiling continuously acts as a barrier to the further spread of such fire.

DETAILED DESCRIPTION OF FIGS. 4 THROUGH 15 OF THE DRAWINGS

These figures show a construction of a preferred embodiment of a fire strip of the invention.

Figure 4:
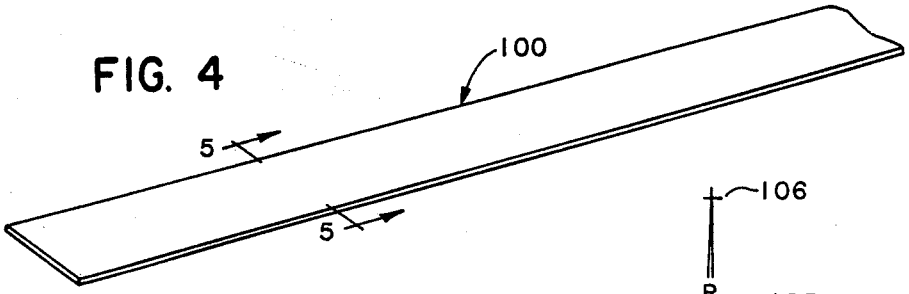
FIG. 4 is a fragmentary perspective view showing a strip of thin spring steel.
Figure 5:
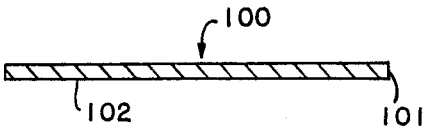
FIG. 5 is an enlarged transverse sectional view taken on the line 5,5 of FIG. 4, showing the rectangular proportions of the steel strip shown in FIG. 4.
Figure 6:
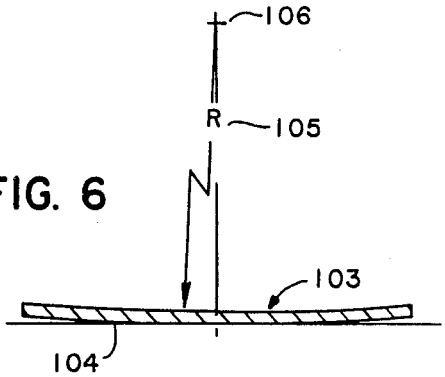
FIG. 6 is a view similar to FIG. 5, but showing the steel strip of FIG. 4 after a forming operation that produces a permanent, large radius of cross-sectional curvature, along the strip.

There is shown in FIG. 4 a web 100 of a continuous length of spring steel. Such web 100 has a flat rectangular cross section as seen in FIG. 5 of, for instance, 0.024″ in thickness 101 and 0.90″ in width 102. The steel is desirably such as to be able to be formed into a strip 103 of slightly curved cross section 104, as seen in FIG. 6, while retaining its springy characteristics. A suitable radius of curvature 105 having an axis at 106 could be about 2″.

Figure 7:
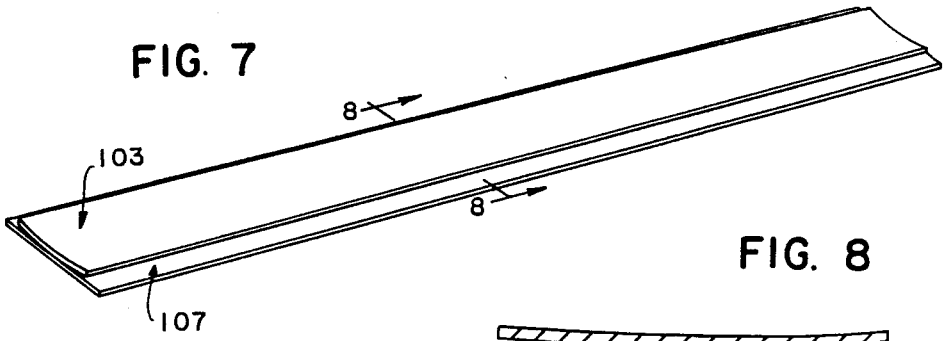
FIG. 7 is a fragmentary perspective view showing the sectionally arcuately formed steel strip axially and centrally positioned over a relatively thinner and wider prepainted metallic strip, the steel strip being concave upwardly.
Figure 8:
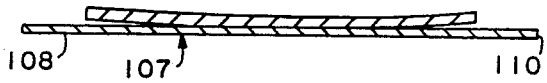
FIG. 8 is an enlarged transverse sectional view taken on the line 8,8 of FIG. 7.

In FIG. 7, there is shown the concave formed strip 103 of FIG. 6 positioned adjacent a continuously extending outer continuous web 107. Web 107 is of a relatively soft steel, rectangular in cross section, and of a width 108 greater than web 107, so that web 107 extends in width beyond the width of strip 103 as seen in FIG. 8. Web 107 can be, for instance, about 1.3″ in width so that about 0.2″ extends beyond strip 103 on either side thereof. Web 107 can be of a thickness 110 of, for instance, 0.0115″. Web 107 is suitably prepainted to any desired color.

Figure 9:
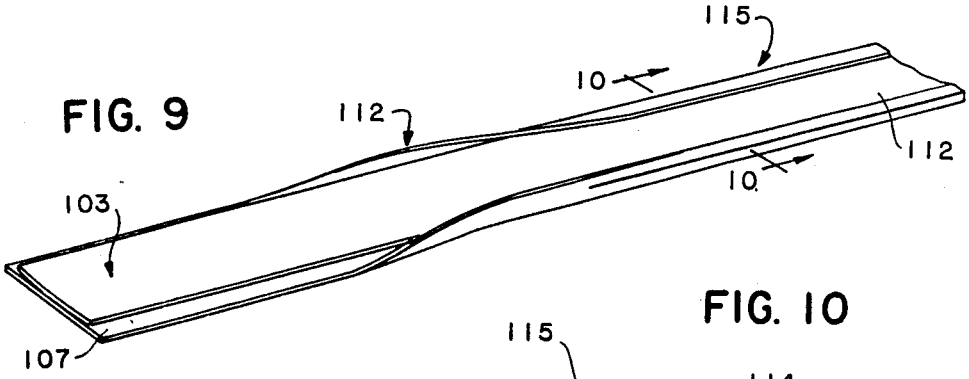
FIG. 9 is a fragmentary perspective view illustrating the bending and edge-forming process that results in the pre-painted thin metallic strip, conforming to and becoming an integral part of the arcuately shaped thicker steel inner strip.
Figure 10:
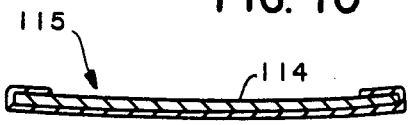
FIG. 10 is an enlarged transverse sectional view, taken on the line 10,10 of FIG. 9.
Figure 11:
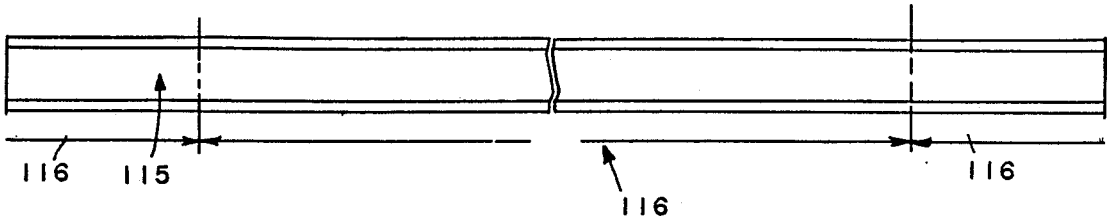
FIG. 11 is a reduced scale, plan view showing the cutting of the composite strip into desired lengths.

Continuous web 107 is then continuously wrapped around curved strip 103 at 112 as by roll forming (not shown) in the manner shown generally in FIG. 9 to form a continuous composite strip 115 having a cross section 114 as shown in FIG. 10. Such strip 115 has a curve in cross section 114 which conforms to the curve of strip 103, since web 107 has virtually no resilient tendencies in that it is of a relatively soft steel of the type commonly used in forming grid members for suspended panel ceilings.

Figure 12:
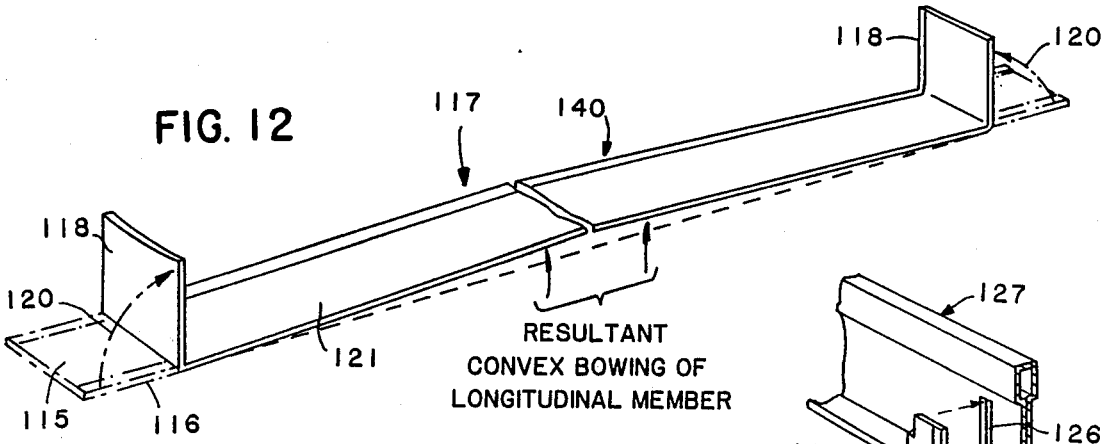
FIG. 12 is a perspective view of a desired length of the composite strip with predetermined short lengths of its terminal ends bent into a vertical position, the vertical portions shown in full lines and the pre-bent condition in dot-and-dash lines. In addition, the drawing illustrates a resulting convex bowing of the longitudinal portion of the composite strip lying between the vertical end portions in accordance with the invention.

Continuous composite strip 115 is then cut lengthwise into segments 116 which conform to the length of the finished strip 117 plus the length of both end flanges 118, as seen in FIG. 12.

As further seen in FIG. 12, the end flanges 118 are bent upward, as at 120, to a position normal to the strip body 121. As flanges 118 are formed, strip body 121 assumes a springy, yieldable, upwardly curved arch 140 as seen in FIG. 12. The interaction between inner web 104, which as explained above is of spring steel formed into a curved cross section, and the outer web 107, which is of soft steel and wrapped around inner web 104, when length 116 is bent to form flanges 118, creates such an arch 140.

Such an arch shape 140 is the required shape to hold the strip snugly against a ceiling panel when the panel is in place in the ceiling during normal room conditions.

Figure 13:
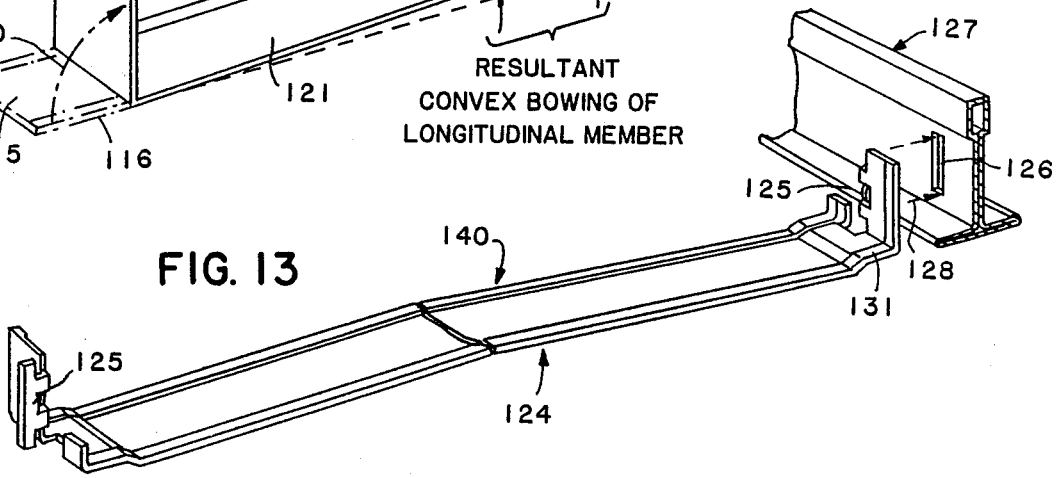
FIG. 13 is a perspective view of a finished fire strip showing the upstanding ends punched, died and trimmed and having a horizontally extending stepped portion, the horizontally extending portion between the upstanding ends retaining the resultant convex curvature in accordance with the invention. In addition, a fragmentary portion of a T-shaped cross member is shown into which the fire strip is interlocked.
Figure 14:
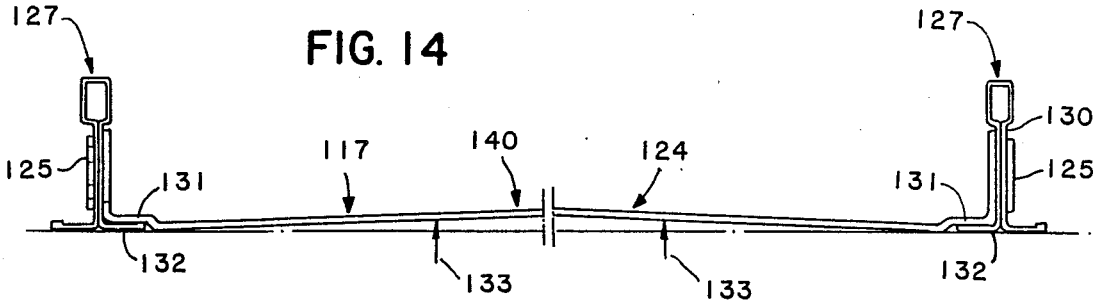
FIG. 14 is a sectional elevational view, illustrating a fire strip interlocked between two parallel T-shaped cross members showing its horizontally extending portion in its convex bowed condition.

Suitable tabs 125 are formed in flanges 118 to form finished strip 124. Tab 125 extends through slot 126 formed in grid member 127. Tab 125 is inserted in slot 126 in the direction shown at 128 in FIG. 13 and then bent along web 130 to the position shown in FIG. 14. An offset 131 is formed in strip body 117 to provide a clearance for flange 132 of grid member 127. Strip body 117 continues to extend in an upwardly extending, yieldable, spring-like arch 140 as shown at 113 in FIG. 14.

Figure 15:
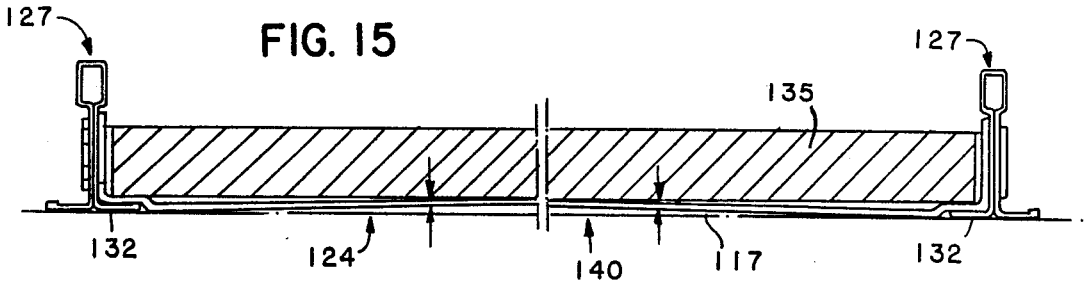
FIG. 15 is a view similar to FIG. 14, but having a panel in place, its weight bearing down against the upward portion of the fire strip, keeping both strip and tile in a tightly conforming interface, in accordance with the invention.

When a ceiling panel 135, shown in cross section in FIG. 15, is placed in position within a ceiling grid opening so that it rests on flanges 132 of grid cross members 127, the arch 140 of body 117 of strip 124 yields to conform to the panel surface, resting snugly against the bottom of panel 135. When observed from below the ceiling, strip 124 appears to be a structural member no different from the grid members having T-shaped cross sections.

In case of a fire, as ex above the strip stays secured to the cross members 127, forming a structural member that helps to keep the grid members from twisting apart, and also served to block the panel from dropping out of the grid structure in the suspended ceiling.

I claim:

1. A fire strip, including a strip body, having an under side and an upper side, and first and second ends, for a grid ceiling for supporting panels, comprising:

(a) an inner web of spring steel on the upper side of the strip and having a preformed arcuate cross section extending concavely upwardly, and having a top, a bottom and side edges, (b) an outer web disposed of soft steel at said bottom of the inner web on the under side of the strip and having edge portions wrapped around the side edges of the inner web and bent to lie along the top of the inner web, (c) end portions at both ends of the strip bent upwardly substantially normal to the strip body, and (d) fastening means on said end portions securing the ends of the strip to grid members;

wherein the body of the strip has an upwardly extending, spring-like, yieldable arch.

* * * * *